United States Patent [19]

Krichevsky et al.

[11] Patent Number: 4,626,815

[45] Date of Patent: Dec. 2, 1986

[54] POLYPHASE ASSEMBLY

[75] Inventors: Mendel Krichevsky; Raul Rabinovici, both of Beer Sheva; Benjamin Sharir, Ramat Gan, all of Israel

[73] Assignee: Ben-Gurion University of the Negev Research and Development Authority, Beer Sheva, Israel

[21] Appl. No.: 644,508

[22] Filed: Aug. 27, 1984

[30] Foreign Application Priority Data

Sep. 7, 1983 [IL] Israel ..... 69676

[51] Int. Cl.[4] ..... H01F 33/00

[52] U.S. Cl. ..... 336/5; 336/84 M; 336/155

[58] Field of Search ..... 336/5, 10, 12, 84 R, 336/84 C, 84 M, 155; 323/361

[56] References Cited

U.S. PATENT DOCUMENTS

| | | | |
|---|---|---|---|
| 2,314,083 | 3/1943 | Finch | 366/12 X |
| 2,878,441 | 3/1959 | Rogers et al. | 336/84 C |
| 3,195,082 | 7/1965 | Wetherill et al. | 366/12 |

FOREIGN PATENT DOCUMENTS

| | | | |
|---|---|---|---|
| 346195 | 12/1921 | Fed. Rep. of Germany | 336/12 |
| 2038849 | 2/1972 | Fed. Rep. of Germany . | |
| 479748 | 5/1916 | France . | |
| 2024029 | 8/1970 | France . | |
| 2122410 | 9/1972 | France . | |
| 1322433 | 7/1973 | United Kingdom . | |
| 1331748 | 9/1973 | United Kingdom . | |
| 1484523 | 9/1977 | United Kingdom . | |
| 2075271 | 11/1981 | United Kingdom . | |

OTHER PUBLICATIONS

Practical Transformer Design Handbook—Eric Lowdon, 2nd printing, 1981, Sams and Co. Inc., p. 54.

Patents Abstracts of Japan, vol. 6, No. 211 (E-137) (1089), 23rd Oct. 1982.

*Primary Examiner*—Arthur T. Grimley

*Assistant Examiner*—C. Romano

[57] ABSTRACT

There is provided a polyphase assembly for controlling A.C. devices and capable of producing an electrical impedance of a substantial resistive component. The assembly has a plurality of windings, separate for each phase, wound on and along a single, axially directed core. The core is constituted by at least one ferromagnetic body. The air boundary to air boundary thickness of at least the portions of the core covered by the windings is greater than 1.6 mm.

10 Claims, 12 Drawing Figures

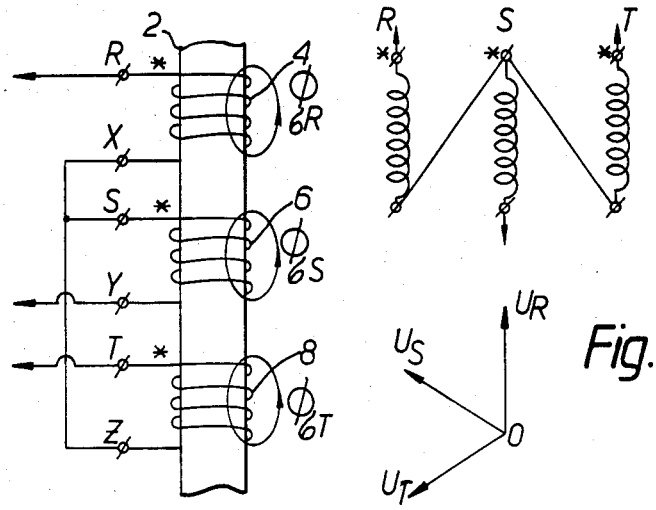
Fig.6.
Fig.7.
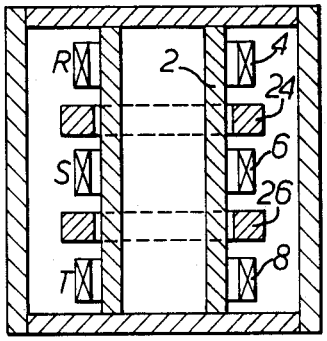
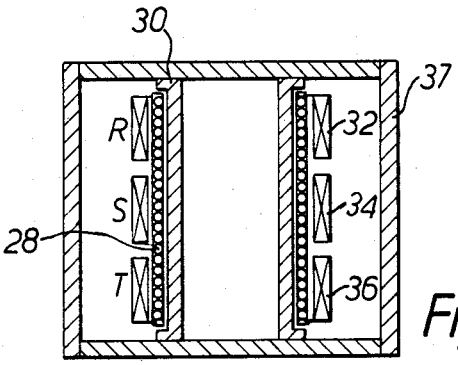
Fig.8.
Fig.9.
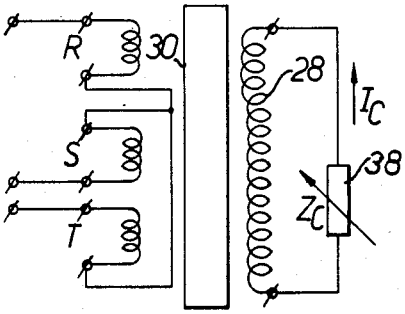

POLYPHASE ASSEMBLY

BACKGROUND OF THE INVENTION

The present invention relates to a polyphase assembly for controlling A.C. devices and more particularly to an assembly capable of producing an electrical impedance of a substantial resistive component, which assembly utilizes eddy currents energy losses.

The commonly known polyphase devices, i.e., three-phase reactors, are constituted by an iron core having three parallely disposed pole pieces interconnected at their ends by cross-pieces. On each pole piece there is wound a coil adapted to be connected to a source of exciting alternating current of a phase different than that of the other two. The magnetic flux generated by each of the coils is distributed along their respective pole pieces and, as known, the sum of the alternating fluxes meeting is a node point of the core is zero.

The structure of the core of this type of reactors necessitates a relatively high degree of accuracy to assure an uninterrupted smooth transmittance of the magnetic flux throughout the branches of the core. This necessity and the physical bulkiness of the core make such devices quite expensive.

It is therefore a broad object of the present invention to provide a polyphase assembly which is less bulky and of a much simpler construction thus much easier to manufacture and more reliable than the conventional multi-phase devices.

SUMMARY OF THE INVENTION

In accordance with the object of the invention there is provided a polyphase assembly for controlling A.C. devices and capable of producing an electrical impedance of a substantial resistive component, comprising a plurality of windings, separate for each phase, wound on and along a single, axially directed core, said core being constituted by at least one ferromagnetic body, the air boundary to air boundary thickness of at least the portions of said core covered by said windings being greater than 1.6 mm.

The term "air boundary to air boundary thickness" as used herein is meant to define the case in which the core is constituted by e.g., a simple rod or bar, as well as the case in which the core is constituted by e.g., a tubular element. In this latter case the term air boundary to air boundary thickness defines the wall thickness of the tubular element and not the diameter of the element. Furthermore, said term is also meant to encompass the possibility of a core made of several laminates, each having an air boundary to air boundary of a minimal thickness, which in accordance with the present invention is 1.6 mm.

In a known polyphase device having a core made up of thin steel laminations the total impedance, Z, of the device is composed of a relatively large reactive component X and a much smaller resistive component R, i.e., $R << X$, and the power factor $\cos\phi = R/Z$ is close to zero.

In contradistinction to such a known device, in the present invention there is produced an impedance Z by means of substantial transformatorically induced losses wherein the resistive component R is in the order of the reactive component X, i.e., $R \approx X$ and thus the power factor $\cos\phi \leqq 0.8$.

Therefore, the term "electrical impedance of substantial resistive component" is meant to designate the case in which the resistive component of the total impedance is of the same order of the reactive component of the total impedance.

In order to achieve substantial electrical energy losses in the core of such devices, the core body has to have sufficient thickness of depth so as to be able to "absorb" or accommodate the changing magnetic field induced therein.

The penetrating depth $\delta$ of a magnetic field in a ferromagnetic body can be calculated from the formula:

$$\delta = \sqrt{1/\pi \cdot f \cdot \sigma \left(\frac{B_m}{H_m}\right)}$$

where:

$H_m$ is the amplitude of a sinusoidal magnetic field on the outside surface of a ferromagnetic body;

$B_m$ is the amplitude of the magnetic induction on the same areas;

$\sigma$ is the specific conductivity of the body's material; and f is the frequency of the changing magnetic field.

Experiments carried out with core bodies made of common constructional steel, produced the following table:

| $H_m$[A/m] | $B_m$[$^T$s] | $\delta$[mm] |
|---|---|---|
| 500 | 0.89 | 0.83 |
| 1,000 | 1.22 | 0.99 |
| 1,500 | 1.31 | 1.17 |
| 2,000 | 1.37 | 1.33 |
| 2,500 | 1.40 | 1.46 |
| 3,000 | 1.44 | 1.58 |
| 3,500 | 1.48 | 1.69 |

Since most, e.g., 86 to 98%, of the energy losses in a core body take place in a depth $\delta$ mm from the outer surface of the body, it can be learned from the above calculations that when magnetic saturation is achieved, the penetration depth is about 1.6 mm. Furthermore, in designing actual devices according to the present invention it was found that by reducing the overall size of the device the actual penetrating depth of the induced magnetic field will be even more than 1.6 mm, e.g., 3 mm.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

BRIEF DESCRIPTION OF THE DRAWINGS

In the drawings:

FIG. 6 is a schematic representation of a polyphase assembly according to the invention showing assymmetric connections of the windings;

FIG. 7 is a cross-sectional view of a further embodiment of a polyphase assembly according to the invention;

FIG. 8 is a cross-sectional view of a polyphase assembly with an additional control winding;

FIG. 9 is a schematic representation of the assembly of FIG. 8 showing a first manner of electrically controlling the ouput of assembly by means of a variable impedance;

DESCRIPTION OF PREFERRED EMBODIMENTS

Figure 1:
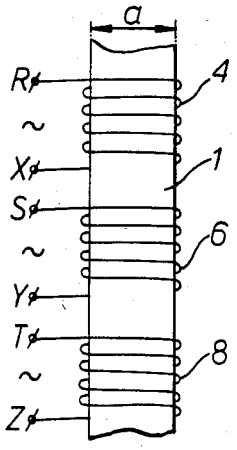
FIG. 1 is a schematic drawing showing a polyphase assembly according to the present invention.

In FIG. 1 there is shown a schematic illustration of a polyphase assembly according to the present invention, which assembly consists of a core 1 which is constituted by a simple ferromagnetic rod or bar having a thickness a greater than 1.6 mm. On the core 1 there are wound three coils or windings respectively, winding 4 having terminals R, X; winding 6 having terminals S, Y, and winding 8 having terminals T, Z. Each pair of terminals is connectable to a source of exciting alternating current of a phase different than the other two. The windings 4, 6 and 8 may all be wound around the core 1 in the same sense or, alternatively, at least one winding of a multiwinding assembly may be wound in a sense opposite to the other windings.

Figure 2:
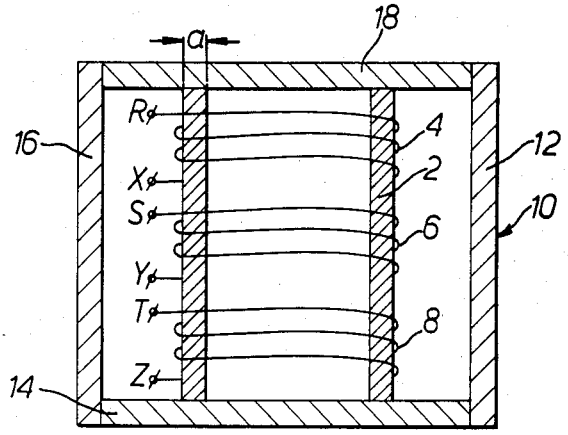
FIG. 2 is a schematic drawing showing a polyphase assembly mounted in a closed magnetic-path frame.

In FIG. 2 there is illustrated a polyphase assembly having a tubular core 2 of a wall thickness a mounted in a ferromagnetic frame 10, constituted by individual metal plates 12, 14, 16 and 18, so as to form an assembly having a single axially directed core 2 and a closed magnetic path. Thus, with such an assembly, most of the generated magnetic flux is distributed through the metallic frame.

Figure 3:
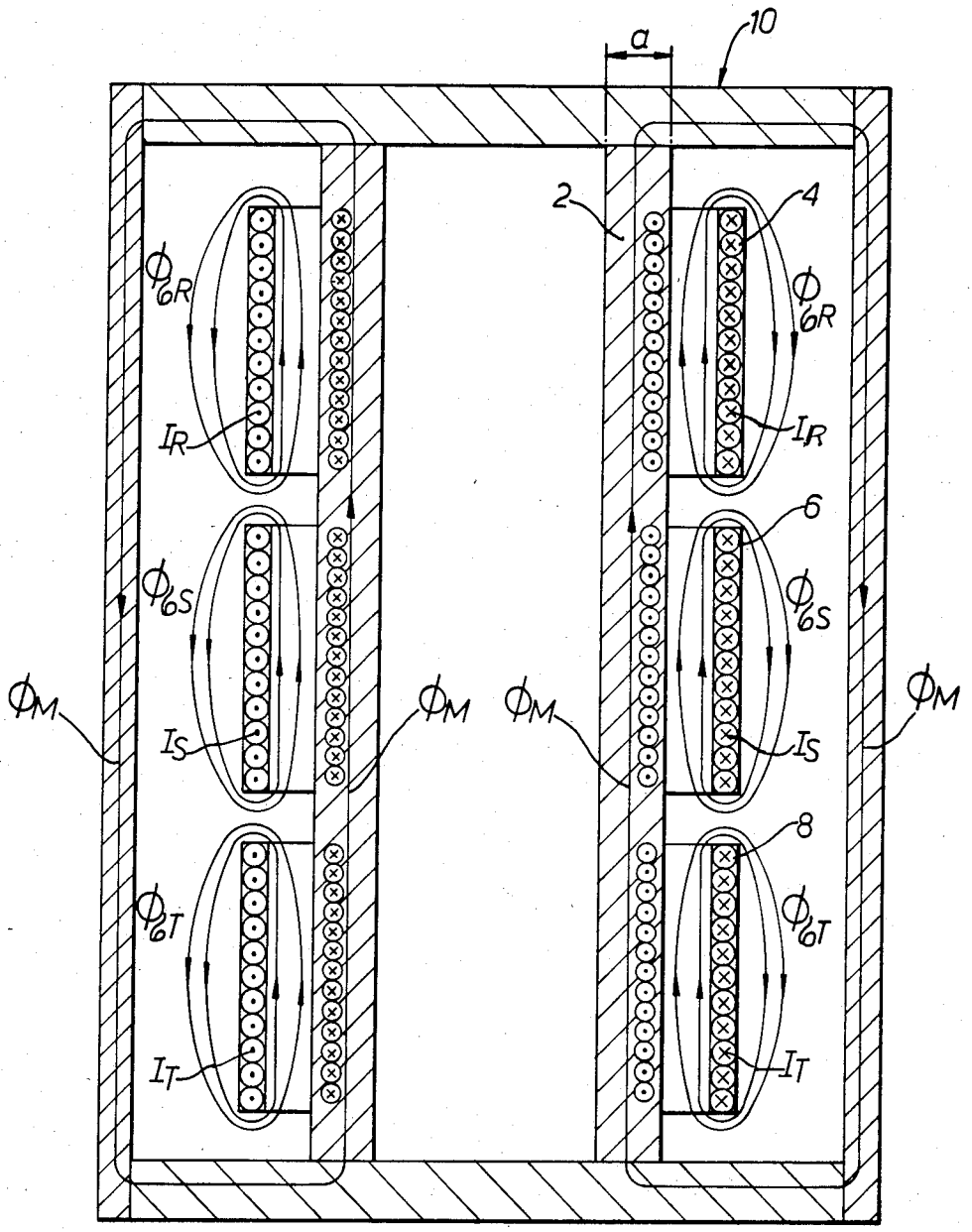
FIG. 3 is a schematic drawing of the embodiment of FIG. 2 illustrating the magnetic flux phases during operation.

Referring now to FIG. 3, there is illustrated an assembly according to FIG. 2 showing the magnetic flux phases during operation. The core 2, mounted in a ferromagnetic frame 10, is constituted by a tubular element having an air boundary to air boundary thickness or a wall thickness $a > 1.6$ mm. As seen the three windings 4, 6 and 8 are wound around substantially the entire length of the hollow axially directed core 2.

When exciting currents $I_R$, $I_S$ and $I_T$ are respectively applied to the windings, there are produced by each of the windings leakage fluxes, respectively, $\phi_{\sigma R}$, $\phi_{\sigma S}$ and $\phi_{\sigma T}$, totalling a leakage flux of $\phi_\sigma$ and a mutual flux $\phi_M$, which mutual flux is induced in the frame 10.

The total flux in the assembly is thus, $$\phi_{\Sigma i} = \phi_M + \phi_\sigma \qquad [1]$$

In the assembly of FIG. 3:

$$\phi_M = \Sigma\phi_i = \gamma_\mu N I_R + \gamma_\mu N I_S + \gamma_\mu N I_T$$
$$= \gamma_\mu N(I_R + I_S + I_T)$$
$$= \gamma_\mu N[Ia \cos \omega t + Ia \cos (\omega t - \tfrac{2}{3}\pi) + Ia(\cos (\omega t + \tfrac{2}{3}\pi)] = 0$$

where:

$\gamma_\mu$ = magnetic conductivity,

N = the number of turns of each of the windings, $I_R$, $I_S$ and $I_T$ = the currents in the windings, Ia = the amplitude value of the current in each of the windings, and $\phi_i$ = the flux produced by a winding i (R,S or T) in the frame.

Although from the theoretical aspect when there exists a complete symmetry between the phases of the assembly then $\phi_M = 0$, since in reality such a complete symmetry can not be achieved, in practice, $\phi_M$ can be neglected.

Therefore, from equation [1] above, it is seen that in the polyphase assembly of FIG. 3 and similarly, of FIGS. 1 and 2, the major portion of the total flux $\phi_{\Sigma i}$ is the leakage flux $\phi_\sigma$, that is $$\phi_{\Sigma i} \approx \phi_\sigma \qquad [b\ 2]$$

Considering now the known sin function of (voltage and) current of the impedance Zi of such electromagnetic devices:

$$Zi = \phi_{\Sigma i} K (N_{i\omega}/I_i) \qquad [3]$$

where:

K is a coefficient depending on the geometry of the core of the device and the frequency and current applied thereto;

$N_i$ = number of turns of the winding;

$I_i$ = current flowing in the coil, and $\omega$ = angular frequency of the current.

If in equation [3] there will be substituted representative values of a conventional electromagnetic device, such as a three-phase transformer having a core made of laminates of a thickness of between 0.2 and 0.5 mm, in which, as known, most of the magnetic flux is distributed through the ferromagnetic core and only a minor portion thereof, e.g., $(\phi_\sigma/\phi_i) = 0.02$ or 0.05 is distributed through the air, then the impedance of a single winding, $Z_{in}$, is:

$$Z_{in} = \Phi_{\Sigma i} \cdot K \frac{N_{i\omega}}{I_i}$$

$$= \Phi_i + \Phi_\sigma \cdot K \frac{N_{i\omega}}{I_i} \quad [\text{since } \Phi_{\Sigma i} = \Phi_i + \Phi_\sigma \text{ and } \Phi_\sigma = 0.05\ \Phi_i]$$

$$= 1.05\ \Phi_M K \frac{N_{i\omega}}{I_i}$$

in accordance with the explanations above, in an assembly according to the present invention if a conventional core, made of laminates having a thickness of between 0.2 and 0.5 mm would have been used, substituting the relevant values in equation [3] above:

$$Z_i = \Phi_\sigma K \frac{N_{i\omega}}{I_i} = 0.05\ \Phi_i K \frac{N_{i\omega}}{I_i} = 0.05\ Z_{in}$$

namely, this figure, in practical terms, is equivalent to a short circuit in the secondary winding.

Therefore, it is a condition of the invention that the core will be made of a massive body or bodies having a thickness as defined hereinbefore of more than 1.6 mm. with such cores there are generated at the outer surfaces thereof eddy currents which prevent the magnetic flux from entering into the depth of the core and thus a substantial amount of the generated flux is looped through the air or the core body and the air and not only or mainly, through the ferromagnetic core as is with the case of a conventional device as described above. For example, it has been found that with an assembly of the type shown in FIG. 3, $(\phi_\sigma/\phi_i) \approx 3.16$ (as compared with 0.02 above).

Figure 4:
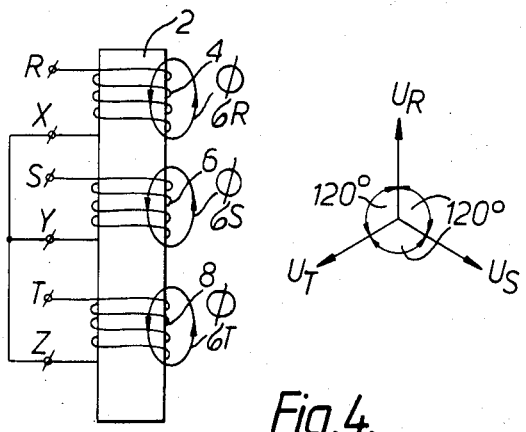
FIG. 4 is a schematic drawing of a star-connected polyphase assembly according to the invention.
Figure 5:
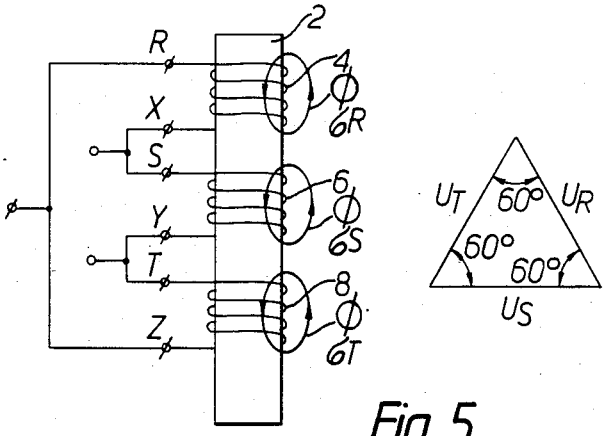
FIG. 5 is a schematic drawing of a delta-connected polyphase assembly according to the invention.

Turning now in general to FIGS. 4 to 7, there are illustrated, in FIGS. 4 and 5, a star-connected and a delta-connected assembly according to the invention. It was, however, found that if the windings are not connected as in the conventional manner of star and delta, but rather in an asymmetric manner as shown in FIG. 6, the vectors between the phases do not change their direction abruptly but rather more gradually.

Asymmetry also occurs in the assembly of FIG. 2 since the windings 4 and 8 are positioned closer to the metallic frame plates 18, and respectively, 14, whereas the winding 6 is positioned further away from the frame plates. Hence, the impedance of the winding 6 is higher than the other two by about 30%.

This asymmetry can be rectified either by reducing the number of turns in the middle winding 6, relative to the windings 4 and 8 bracketing winding 6, or by the introduction of magnetic shielding elements 24 and 26 as shown in FIG. 7. These magnetic shielding elements can be made of simple metallic rings and experiments which were conducted with such assemblies showed that their performance was very similar to the performance of known A.C. control devices. Alternatively, the single axis core may be assembled from several interconnected bodies.

In FIG. 8 there is shown a single axis core polyphase assembly in accordance with the invention, however, with an additional control winding 28 wound around the tubular core 30. The three windings 32, 34 and 36, each carrying exciting current of a different phase are wound around the control winding 28. A magnetic frame 37 encompasses the single axis core and its windings.

Figure 10:
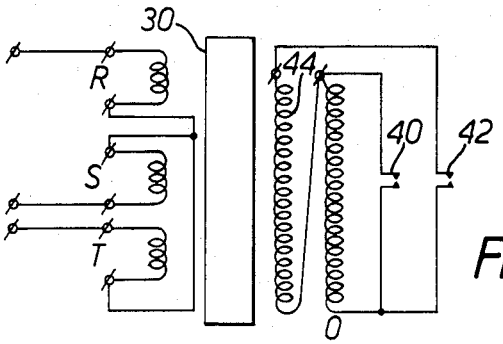
FIG. 10 is a schematic representation of the assembly of FIG. 8 showing a further manner of electrically controlling the output of the assembly by means of contactors.
Figure 11:
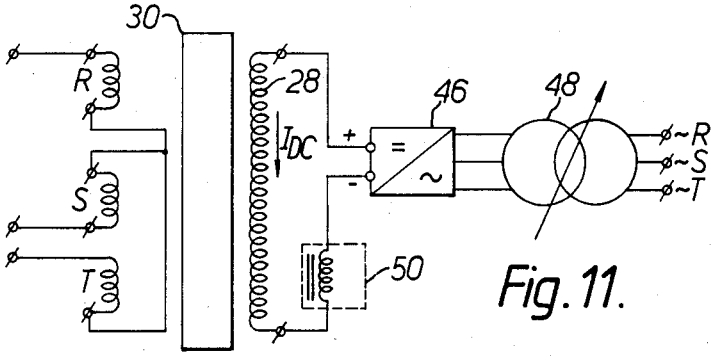
FIG. 11 is a schematic representation of the assembly of FIG. 8 showing still a further way of electrically controlling the output of the assembly by means of magnetic saturation.

In FIGS. 9 to 11 there are illustrated various ways of electrically controlling the output of the assembly shown in FIG. 8. The first way is illustrated in FIG. 9 and includes a variable impedance 38 which is connected across the control winding 28. It is obvious that the value $Z_c$ of the adjustable impedance determins the current $I_c$ which flows in the control winding 28. Thus when the value of the variable impedance is decreased, the current which flows in the respective windings R, S and T will be increased, i.e. the impedance of the assembly will be also decreased. Similarly, with an increase of the value of the variable impedance the impedance of the assembly will increase. It is thus seen that with a single axis polyphase assembly of the present invention it is possible to control the impedance of the polyphases with only one control winding.

The control of the impedance of the assembly can also be achieved by means of contactors 40, 42 (FIG. 10) controlling the number of turns in a control winding 44. It can be shown that an increase in the number of the turns in the control winding 44 will bring about an increase in the utilizable current of the assembly and consequently, cause a decrease in the impedance thereof.

A third manner of controlling the assembly's output is shown in FIG. 11. The control winding 28 is connected to, and fed by, a DC rectifier 46 which rectifier, in turn, is fed by an auto-transformer 48 connectable to a three-phase A.C. source. A choke 50 may optionally be connected in series with the control winding 28. As it is understood, a variation in D.C. current applied to the control winding 28, causes a variation in the direct magnetic field in the core 30 and consequently, there is caused a change of the impedance of the assembly.

Figure 12:
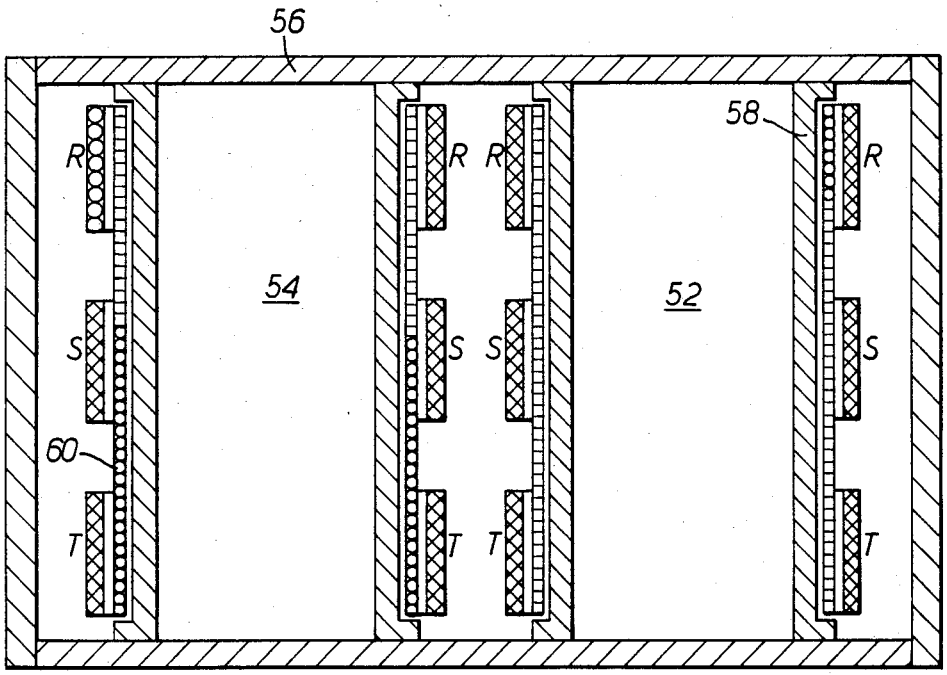
FIG. 12 is a cross-sectional view of two polyphase assemblies mounted within a single frame.

While in FIG. 8 there is shown a single control winding extending along substantially the entire core, other arrangements are also contemplated. For example an arrangement as shown in FIG. 12, wherein two single axis polyphase assemblies 52 and 54 having two control windings 58 and 60, are mounted within a single frame 56.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A polyphase assembly for controlling A.C. devices and capable of producing an electrical impedance of a substantial resistive component, comprising a pluralit- of windings, separate for each phase, wound on and along a single, axially directed core, said core being constituted by at least one ferromagnetic body the air boundary to air boundary thickness of at least the portions of said core covered by said windings being greater than 1.6 mm.

2. The assembly as claimed in claim 1 wherein said core is constituted by at least one bar of a thickness greater than 1.6 mm.

3. The assembly as claimed in claim 1 wherein said core is constituted by at least one hollow tubular element having a wall thickness greater than 1.6 mm.

4. The assembly as claimed in claim 1 wherein said core is mounted within a ferromagnetic frame, said frame constituting a closed path for magnetic flux induced therein.

5. The assembly as claimed in claim 1 further comprising at least one ferromagnetic shielding element affixed to said core inbetween at least two adjacent windings.

6. The assembly as claimed in claim 1 wherein the number of turns of at least one of the windings is different than the number of turns of at least one other winding of the assembly.

7. The assembly as claimed in claim 1 wherein at least one of the windings is wound around the core in a direction opposite to at least one other winding.

8. The assembly as claimed in claim 1 further comprising at least one control winding wound around said core.

9. The assembly as claimed in claim 8 wherein at least one of said windings is wound at least partly around said control winding.

10. The assembly as claimed in claim 1 comprising a plurality of cores mounted within a ferromagnetic frame, each of said cores having a plurality of windings separate for each phase wound on and along each of said axially directed cores.

* * * * *